US009320961B2

(12) United States Patent
Wøllo et al.

(10) Patent No.: US 9,320,961 B2
(45) Date of Patent: Apr. 26, 2016

(54) TOURING OR CROSS-COUNTRY SKI BINDING

(71) Applicant: ROTTEFELLA AS, Klokkarstua (NO)

(72) Inventors: Even Wøllo, Naersnes (NO); Thomas Holm, Oslo (NO); Øyvar Svendsen, Oslo (NO); Aksel Pettersen, Heer (NO)

(73) Assignee: Rottefella AS, Klokkarstua (NO)

( * ) Notice: Subject to any disclaimer, the term of this patent is extended or adjusted under 35 U.S.C. 154(b) by 0 days.

(21) Appl. No.: 14/684,723

(22) Filed: Apr. 13, 2015

(65) Prior Publication Data

US 2015/0209651 A1 Jul. 30, 2015

Related U.S. Application Data

(62) Division of application No. 13/822,679, filed as application No. PCT/NO2011/000254 on Sep. 15, 2011.

(30) Foreign Application Priority Data

Sep. 15, 2010 (NO) ..... 20101289

(51) Int. Cl.
*A63C 9/00* (2012.01)
*A63C 9/08* (2012.01)
(Continued)

(52) U.S. Cl.
CPC ..... *A63C 9/003* (2013.01); *A63C 9/005* (2013.01); *A63C 9/086* (2013.01); *A63C 9/0807* (2013.01);
(Continued)

(58) Field of Classification Search
None
See application file for complete search history.

(56) References Cited

U.S. PATENT DOCUMENTS 4,616,843 A 10/1986 Freisinger et al.
4,915,405 A 4/1990 Rullier et al.
(Continued)

FOREIGN PATENT DOCUMENTS

CN 100571825 C 12/2009
DE 102005026725 A1 6/2006
(Continued)

OTHER PUBLICATIONS

First Office Action of State Intellectual Property Office of People's Republic of China dated Jul. 15, 2014, regarding China Patent Application No. 201180044676.
(Continued)

*Primary Examiner* — Brodie Follman
*Assistant Examiner* — Hilary L Johns
(74) *Attorney, Agent, or Firm* — Harness, Dickey & Pierce, P.L.C.

(57) ABSTRACT

The present provides and a method of assembling a touring or cross-country binding, the touring or cross-country binding comprising: an engagement section for pivotal engagement of a ski shoe engagement pin, the engagement section including a stationary engagement part and a movable engagement part; the stationary engagement part comprising a base and a pair of protruding elements, wherein the distal part of the protruding elements are provided with a recess adapted to receive the ski shoe engagement pin; and the movable engagement part is a slider in sliding engagement with the stationary engagement part; an activation element adapted to move the movable engagement part between a locking position and a releasing position of the engagement pin; and a downwards pointing button arranged on the activation element to directly engage an opening in the movable engagement part, whereby the movable engagement part is sliding forward to the releasing position by a downwards force on the activation element at a position behind the fulcrum pins of the activation element.

11 Claims, 13 Drawing Sheets

(51) Int. Cl.

| | |
|---|---|
| ***A63C 9/086*** | (2012.01) |
| ***A63C 9/20*** | (2012.01) |
| ***A63C 9/18*** | (2012.01) |

(52) U.S. Cl.

CPC ... *A63C 9/18* (2013.01); *A63C 9/20* (2013.01); *Y10T 29/49826* (2015.01); *Y10T 29/49876* (2015.01)

(56) References Cited

U.S. PATENT DOCUMENTS

| | | | | |
|---|---|---|---|---|
| 4,927,168 | A | 5/1990 | Provence et al. | |
| 4,995,632 | A * | 2/1991 | Girault et al. | 280/615 |
| 4,997,199 | A | 3/1991 | Horn | |
| 5,092,620 | A | 3/1992 | Girault et al. | |
| 5,338,053 | A | 8/1994 | Hauglin | |
| 6,017,050 | A | 1/2000 | Girard | |
| 6,027,135 | A * | 2/2000 | Hauglin | 280/615 |
| 6,290,250 | B1 | 9/2001 | Karol | |
| 6,412,808 | B1 | 7/2002 | Chevalier et al. | |
| 6,623,027 | B1 | 9/2003 | Wheeler | |
| 6,957,827 | B2 | 10/2005 | Kogler | |
| 2006/0197312 | A1 * | 9/2006 | Girard et al. | 280/613 |
| 2008/0150256 | A1 | 6/2008 | Girard et al. | |

FOREIGN PATENT DOCUMENTS

| | | | |
|---|---|---|---|
| EP | 0564442 | A2 * | 10/1993 |
| EP | 0564442 | A2 | 10/1993 |
| EP | 1848516 | A1 | 10/2007 |
| EP | 1935461 | A1 | 6/2008 |
| FR | 2 582 226 | A1 | 11/1986 |
| FR | 2 634 134 | A1 | 1/1990 |
| FR | 2 741 543 | A1 | 5/1997 |
| NO | 305307 | B1 | 5/1999 |
| NO | 309364 | B1 | 1/2001 |
| WO | WO-9721474 | A1 | 6/1997 |
| WO | WO-2004050197 | A1 | 6/2004 |
| WO | WO-2006082483 | A1 | 8/2006 |
| WO | WO-2011/006542 | A1 | 1/2011 |
| WO | WO-2011/006544 | A1 | 1/2011 |

OTHER PUBLICATIONS

Norwegian Search Report for NO20101289, Dated Feb. 22, 2011, 2 pages.

International Search Report, ISA/EP, Rijswijk, NL (4 pages) and International Preliminary Report on Patentability with annexes, IPEA/EP, Munich (7 pages).

Search Report for corresponding CN application, Sep. 11, 2014, 2 pages.

* cited by examiner

TOURING OR CROSS-COUNTRY SKI BINDING

CROSS-REFERENCE TO RELATED APPLICATIONS

This application is a divisional of U.S. patent application Ser. No. 13/822,679 filed on May 17, 2013, which is a 371 U.S. National Stage of International Application No. PCT/NO2011/000254, filed Sep. 15, 2011, which claims priority to Norwegian Patent Application No. 20101289, filed Sep. 15, 2010. The disclosures of the above applications are incorporated herein by reference.

FIELD

The present invention relates to a method of assembling an improved ski binding for touring or cross-country skiing.

BACKGROUND

This section provides background information related to the present disclosure which is not necessarily prior art.

As is well known by any manufacturer of ski bindings, as well as most users of ski bindings, a ski binding should comprise of as few functional parts as possible to functionally flawless in use when exposed to repetitive stress, snow, ice and water entering and freezing within the binding.

Moreover, less functional parts allows easier assembly and lower production cost of the binding. To further reduce production cost while simultaneously offering a high quality binding to a customer at acceptable sale price, is it advantageously to allow most or all of the assembly of the parts of the binding to be performed in a fully automatic process. The fewer manual operations required, the less expensive the binding becomes.

Currently there exists a very large amount of ski bindings on the market, and a substantial number of these bindings is based on the well-known NNN norm, i.e. for use with ski shoes that has a transversal engagement pin mounted underneath the front of the sole of the ski shoe, the binding engaging the engagement pin at either end of the engagement pin or parts of the engagement pin. Several of these ski bindings are constructed in a way that requires several manual and/or complicated automated operations to able to assemble the different parts of the binding. In particular, in an automated assembly operation it is disadvantageous to allow operations performed from different directions, i.e. some operation in a vertical direction, some in a horizontal direction as well as at an angle relative to these directions. Also, rotating a constructional part or element could complicate or add further complexity or cost of the required equipment. Operations in several directions to assemble parts could therefore include joining certain parts either manual or in different position prior to the in-line part assembly.

Thus, an object of the present invention is to provide a ski binding that comprises construction parts or elements that are easy to assemble; that has a simple, yet reliable release mechanism with improved release-element functionality; that provides an improved shoe fixing member; and offers an easy method to assemble the parts.

The following non-exclusive list over references to prior art is listed to illustrate some of the disadvantages of the prior art that the present intentions aims at solving. U.S. Pat. No. 5,338,053; EP 1,848,516 B1 and WO 04/050197A1 all relates to a ski binding that requires more constructional parts than envisaged and offered by the present invention, and that further requires that the constructional parts is mounted from different directions.

To illustrate prior art release mechanisms having a release button and a shoe fixing element it is referred to EP 1,848,516 B1; U.S. Pat. No. 5,092,6; U.S. Pat. No. 6,957,827; U.S. Pat. No. 4,997,199; U.S. Pat. No. 4,915,405; U.S. Pat. No. 4,616,843 and U.S. Pat. No. 6,412,808. Another reference to prior art relating to a snowboard binding is U.S. Pat. No. 6,290,250. These prior art references either includes an element that transfers the force between a locking button and a locking slider, or an additional locking element that secures the shoe in the binding and wherein such an locking element in turn is operated by the locking slider by activation of the locking element.

U.S. Pat. No. 5,092,620; U.S. Pat. No. 6,957,827; U.S. Pat. No. 6,623,027; U.S. Pat. No. 4,616,843 and WO 04/050197 A1 relates to the aspect regarding a locking slider of a ski binding.

SUMMARY

This section provides a general summary of the disclosure, and is not a comprehensive disclosure of its full scope or all of its features.

The ski binding according to the present invention is defined by claim 1 and accompanying dependent claims 2-13. The method of assembling the parts of the ski binding is defined by the steps of claim 14 and accompanying dependent claims 15-17.

An aspect of the present invention relates to a touring or cross-country binding comprising:

- an engagement section 2.1 for pivotal engagement of a ski shoe engagement pin 21, the engagement section including a stationary engagement part 4 and a movable engagement part 5; the stationary engagement part 4 comprising a base 4.1 and a pair of protruding elements 4.2, wherein the distal part of the protruding elements 4.2 are provided with an recess 4.3 adapted to receive the ski shoe engagement pin; and the movable engagement part 5 is a slider in sliding engagement with the stationary engagement part 4;
- an activation element 6 adapted to move the movable engagement part 5 between a locking position and a releasing position of the engagement pin; and
- a downwards pointing button 6.2 arranged on the activation element 6 to directly engage an opening 5.3 in the movable engagement part, whereby the movable engagement part 5 is sliding forward to the releasing position by a downwards force on the activation element 6 at a position behind the fulcrum pins 6.1 of the activation element.

Further, the present invention relates to a ski binding as disclosed above having alternative features, wherein:

- at least one locking element 5.1 is arranged on the movable engagement part 5 in the locking position co-operating with the recesses 4.3 to provide a means for locking the engagement pin 21; and the at least one locking element 5.1 in the releasing position is displaced from the recesses 4.3 in the lengthwise direction of the binding.
- a spring 8 is arranged between an abutment 7.5 at the bottom 7.1 of a first housing section 7 and an abutment 5.4 on the movable engagement part 5 to provide spring loading of the movable engagement part 5 and the activation element 6.
- the stationary engagement part 4 is positioned below the movable engagement part 5 and rests on a first housing section 7, whereby the movable engagement part 5 at its front area is sliding on top of the bottom of the first housing section 7, and at is rear area is sliding on the stationary engagement part 4.

the stationary engagement part 4 is positioned above the movable engagement part 5, and the stationary engagement part 4 have feet or other fastening means engaging the bottom of a first housing section 7, whereby the movable engagement part 5 on its underside is sliding on the bottom of the first housing section 7 and on the upper surface on the rear area is in sliding connection with an underside of the stationary engagement part 4.

a second housing section 9 is provided, the second housing section adapted to interlocking snap connection with the first housing section 7.

the front area of the second housing section 9 is provided with two recesses 9.1 constituting a pivotal engagement with the upper part of the fulcrum pins 6.1.

the second housing section 9 is provided with an opening 9.2 to accommodate the pair of protruding elements 4.2 and the at least one locking element 5.1.

a first housing section 7 is adapted to releasable and adjustable snap fastening on a base element 1.1, the base element 1.1 being fixed to, or integrated with a ski 1.

at least one resilient elements 10,11 is fastenable to the second housing section 9, where at least one resilient element is fastened, respectively in front of 10, or behind 11 the engagement section 2.1 for pivotal engagement of the ski shoe.

the front resilient element 10 is fastenable to the second housing section 9 from underneath the second housing section 9.

the back resilient element 11 is fastenable to the second housing section 9 from above the second housing section 9.

the first housing section 7, the spring 8, the stationary engagement part 4, the movable engagement part 5, the activation element 6, and the second housing section 9 all are assembled by successive vertical directed mounting steps.

Further the invention relates to a method for assembling functional parts of a touring- or cross country ski binding to provide a binding for releasable engagement with an engagement means of a ski shoe, comprising the steps of:

a) providing a first housing section 7;

b) positioning, by a downwards vertical motion, one end of a spring 8 against an abutment 7.5 of the first housing section 7, whereby the spring extends in longitudinal direction of the first housing section 7;

c) positioning, by downwards vertical motions, the stationary 4 and movable 5 engagement parts on a bottom 7.1 of the first housing section 7, whereby the movable engagement part 5 is arranged in sliding engagement with guides 7.4 of the first housing section and in abutment with the second end of the spring 8;

d) positioning, by a downwards vertical motion, an activation element 6 on the first housing section 7, whereby a downwards pointing button 6.2 of the activation element 6 is arranged in abutment with an opening 5.3 in front of the movable engagement part 5; and e) connecting by a downwards vertical motion, a second housing section 9 on the first housing section 7 by means of an interlocking snap connection.

The method can further comprise one or more steps:

wherein step d) further comprises: positioning fulcrum pins 6.1 of the activation element 6 in bearing surfaces 7.3 on a pair of side elements 7.2 extending from the first housing section 7.

wherein step c) comprises positioning the stationary engagement part 4 prior to positioning the movable engagement part 5.

wherein step c) comprises position the movable engagement part 5 prior to positioning the stationary engagement part 4.

wherein a resilient element 10 is positioned by a downwards vertical motion on top of the stationary and movable engagements parts 4,5 prior to performing step e).

wherein a resilient element 10 is positioned in an opening 9.2 of the second housing section 9 prior to performing step e).

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2:
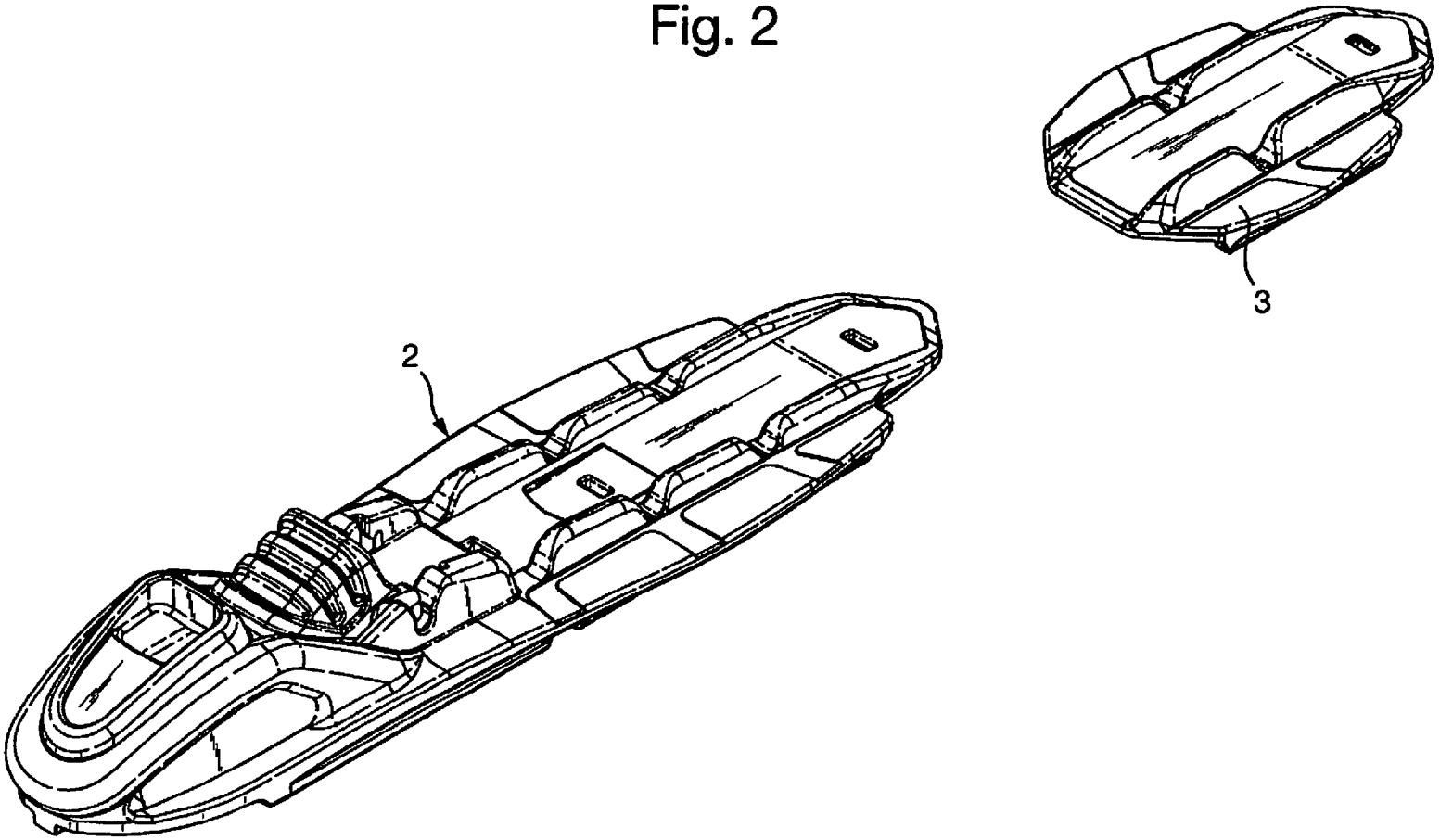
FIG. 2 illustrates a front and back section of the ski binding of FIG. 1.
Figure 4A:
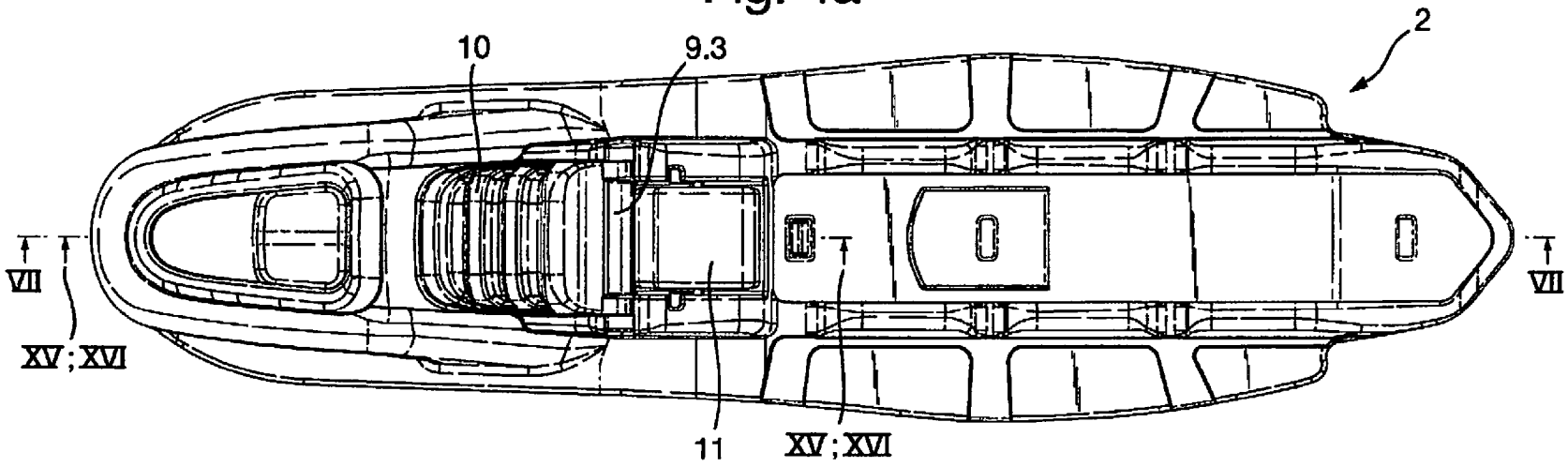
Figure 4B:
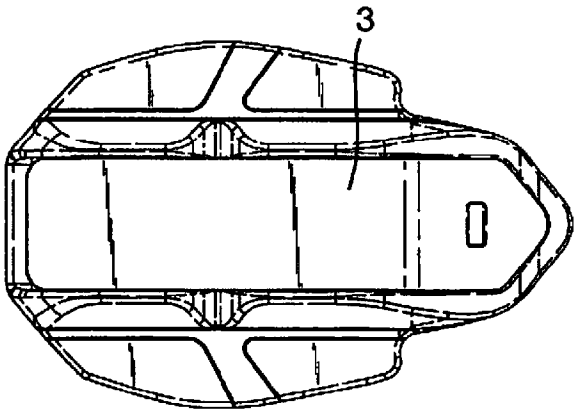
Figure 5A:
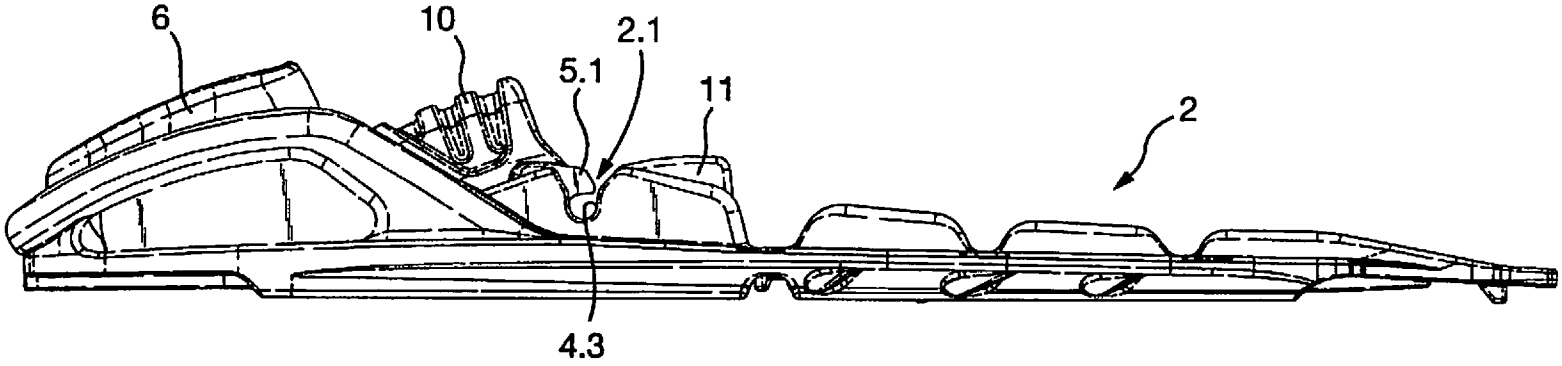
Figure 5B:
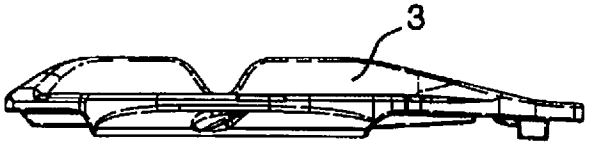
Figure 6A:
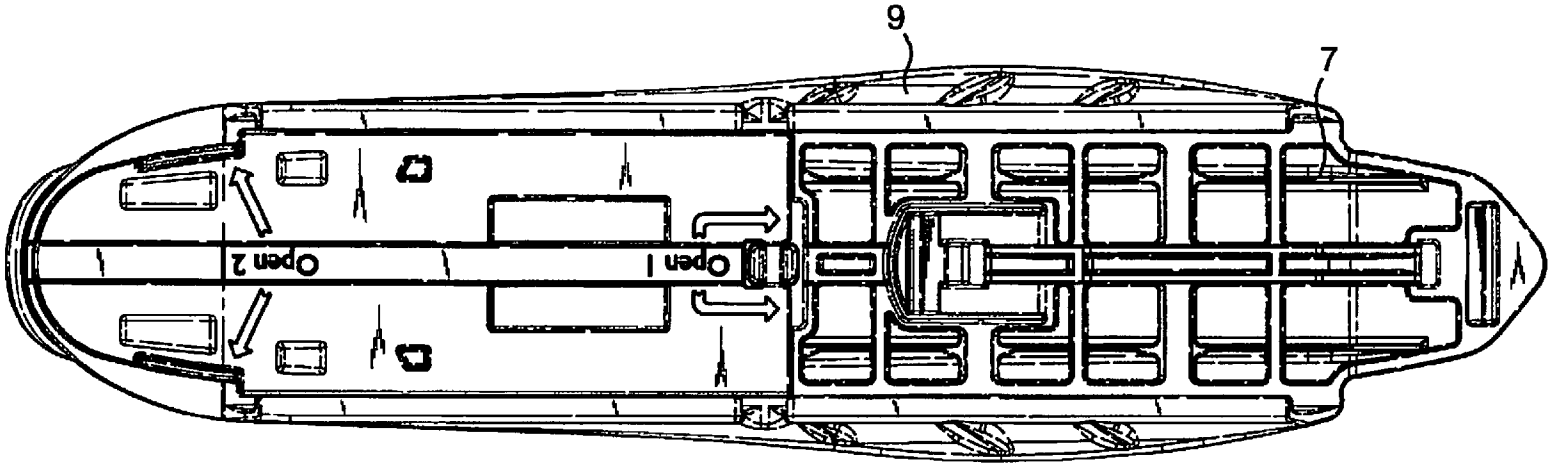
Figure 6B:
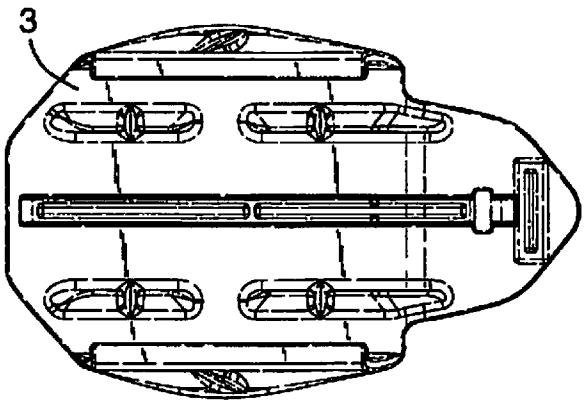
Figure 7:
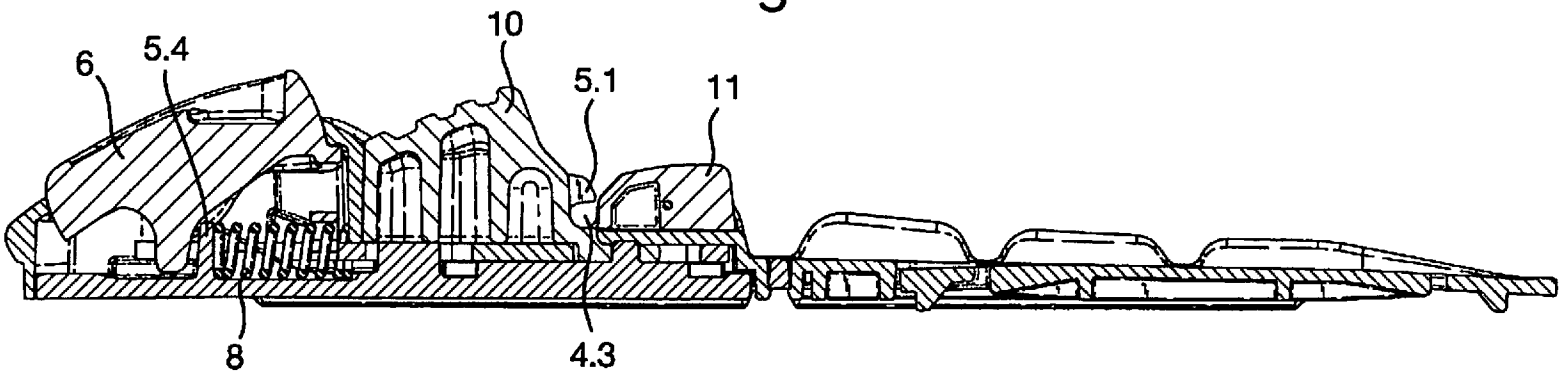

FIGS. 4*a* and 4*b* are top views of the ski binding sections of FIG. 2;

FIGS. 5*a* and 5*b* are side views of the ski binding sections of FIG. 2;

FIGS. 6*a* and 6*b* are bottom views of the ski binding sections of FIG. 2;

FIG. 7 illustrates the cross section VII-VII of FIG. 4*a;*

Figure 8:
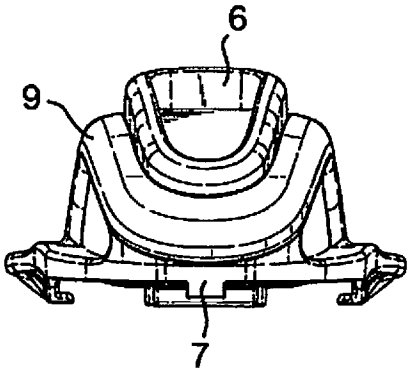
Figure 9:
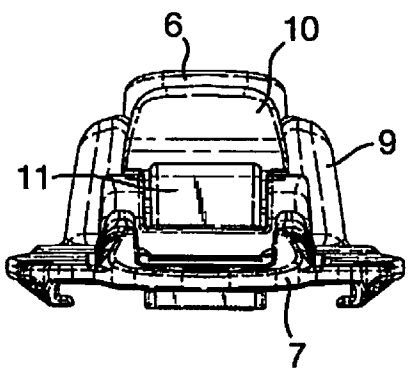

FIGS. 8 and 9 are front and back views of the ski binding section of FIGS. 4*a*, 5*a* and 6*a;*

Figure 10:
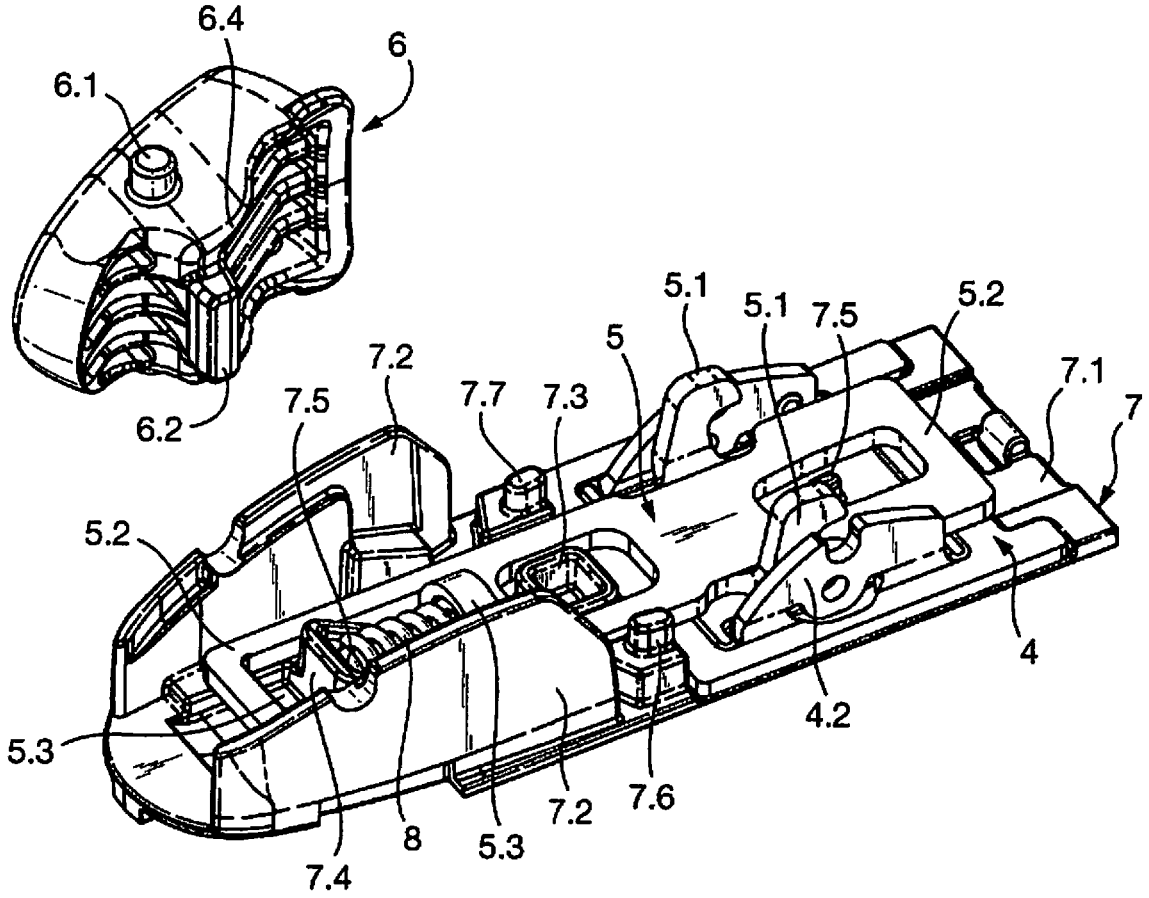
Figure 11:
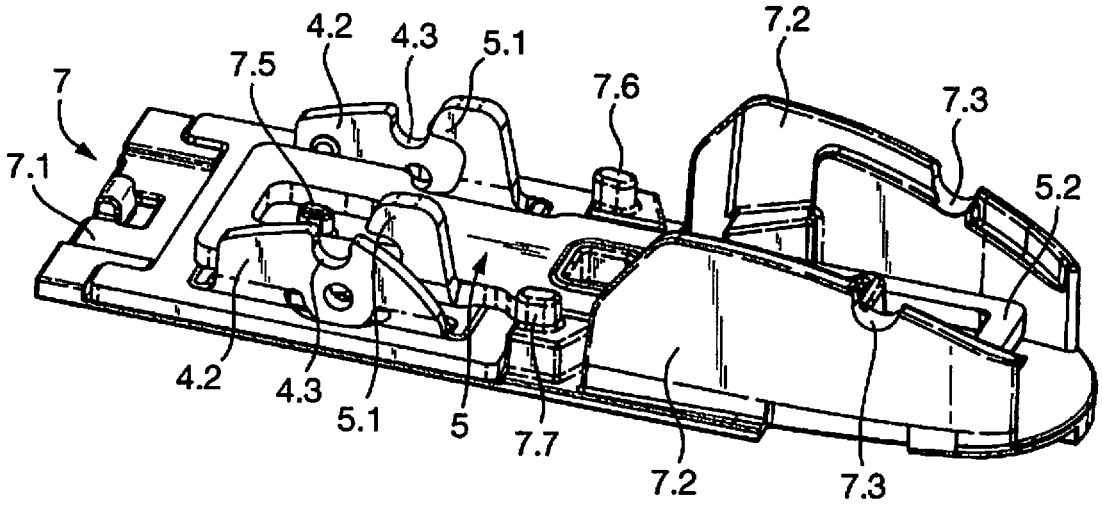
Figure 12:
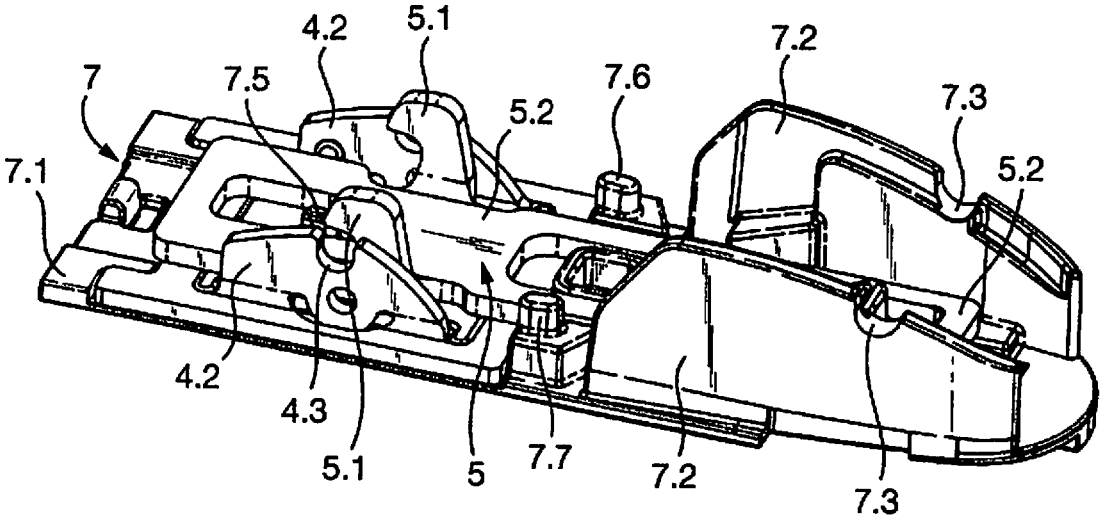

FIG. 10 is a perspective view of the top and a first side of the release- and locking mechanism in the front section of the ski binding according to the present invention;

FIG. 11 is a perspective view of the top and the second side of the release- and locking mechanism of FIG. 10 according to the present invention, and illustrates the locking slide in a released, non-locking position;

FIG. 12 is a perspective view of the top and the second side of the release- and locking mechanism as illustrated in FIG. 10 according to the present invention, and illustrates the locking slide in a locking position.

Figure 13:
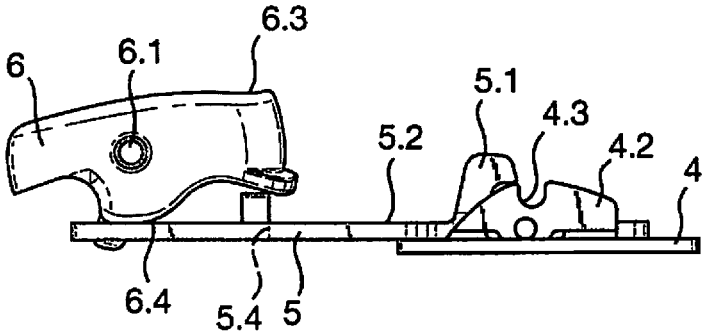
Figure 14:
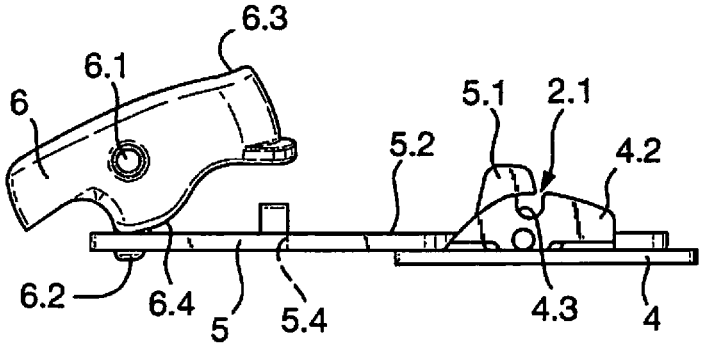

FIGS. 13 and 14 illustrates one operational aspect of the release- and locking mechanism part of the front section of the ski binding according to the present invention.

Figure 15:
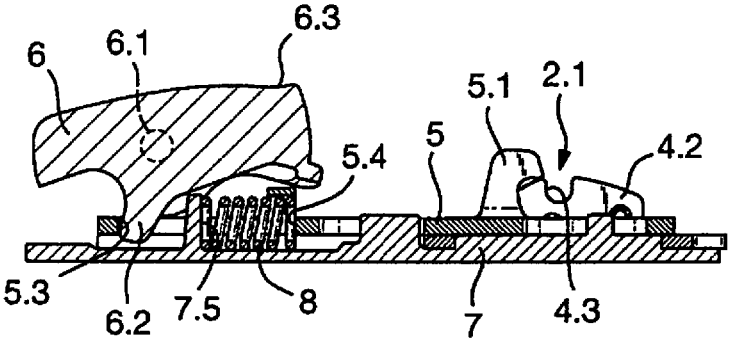
Figure 16:
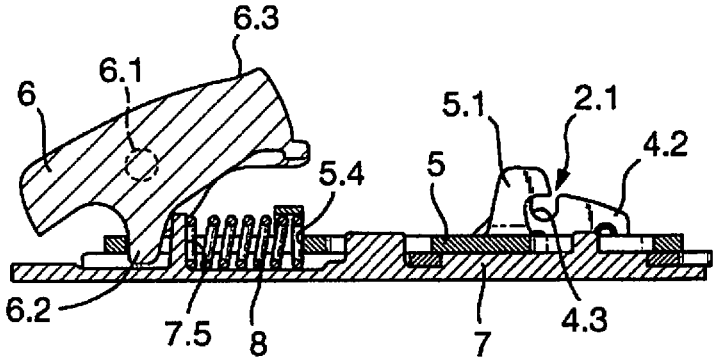
Figure 17:
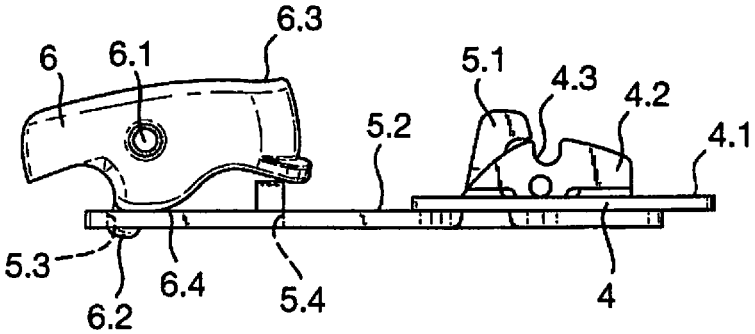
Figure 18:
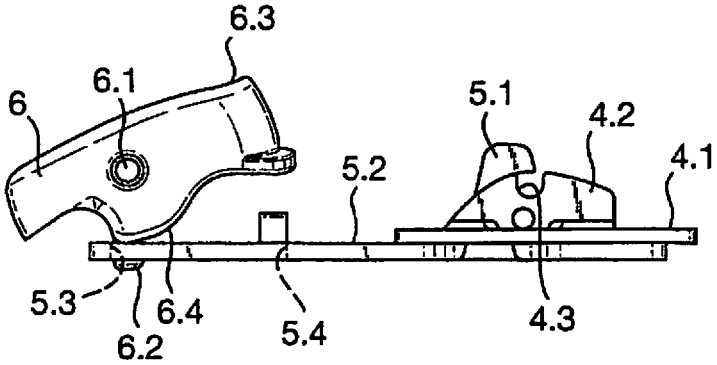
Figure 19:
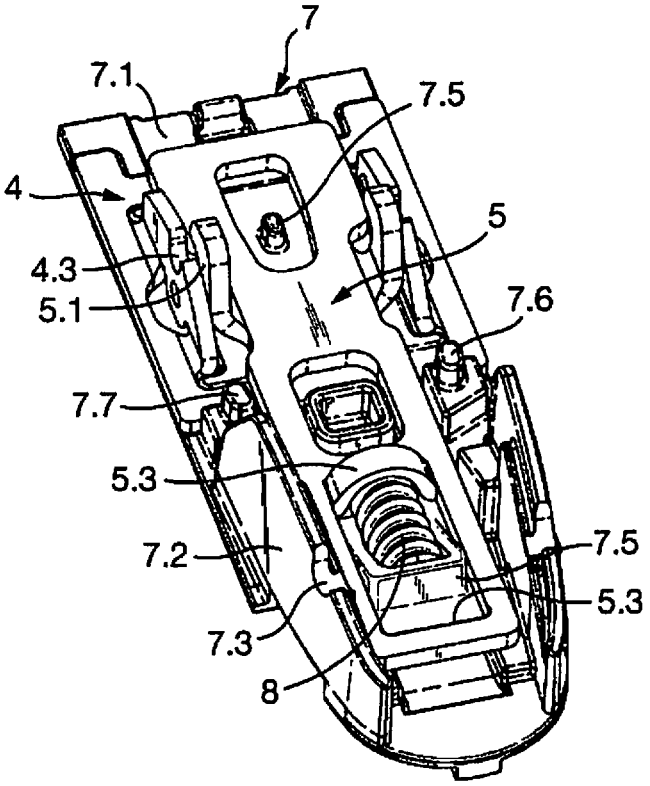
Figure 20:
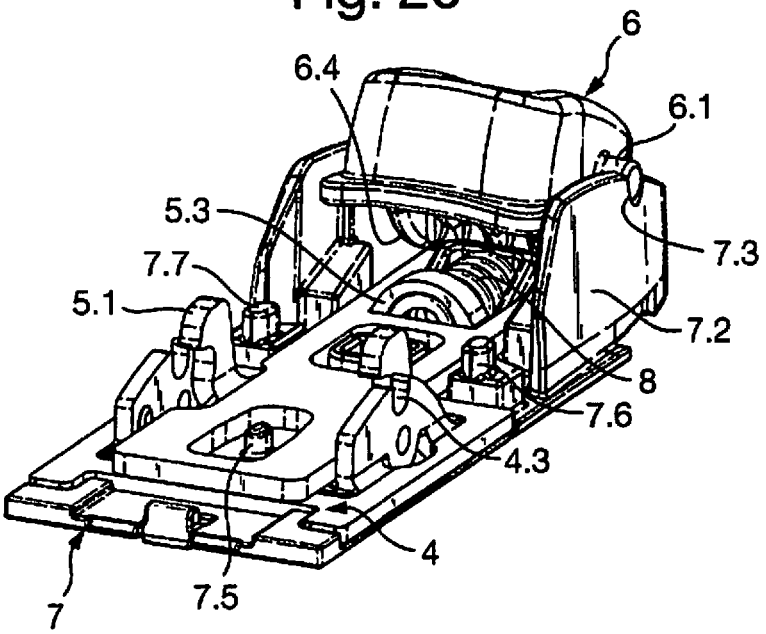
Figure 21:
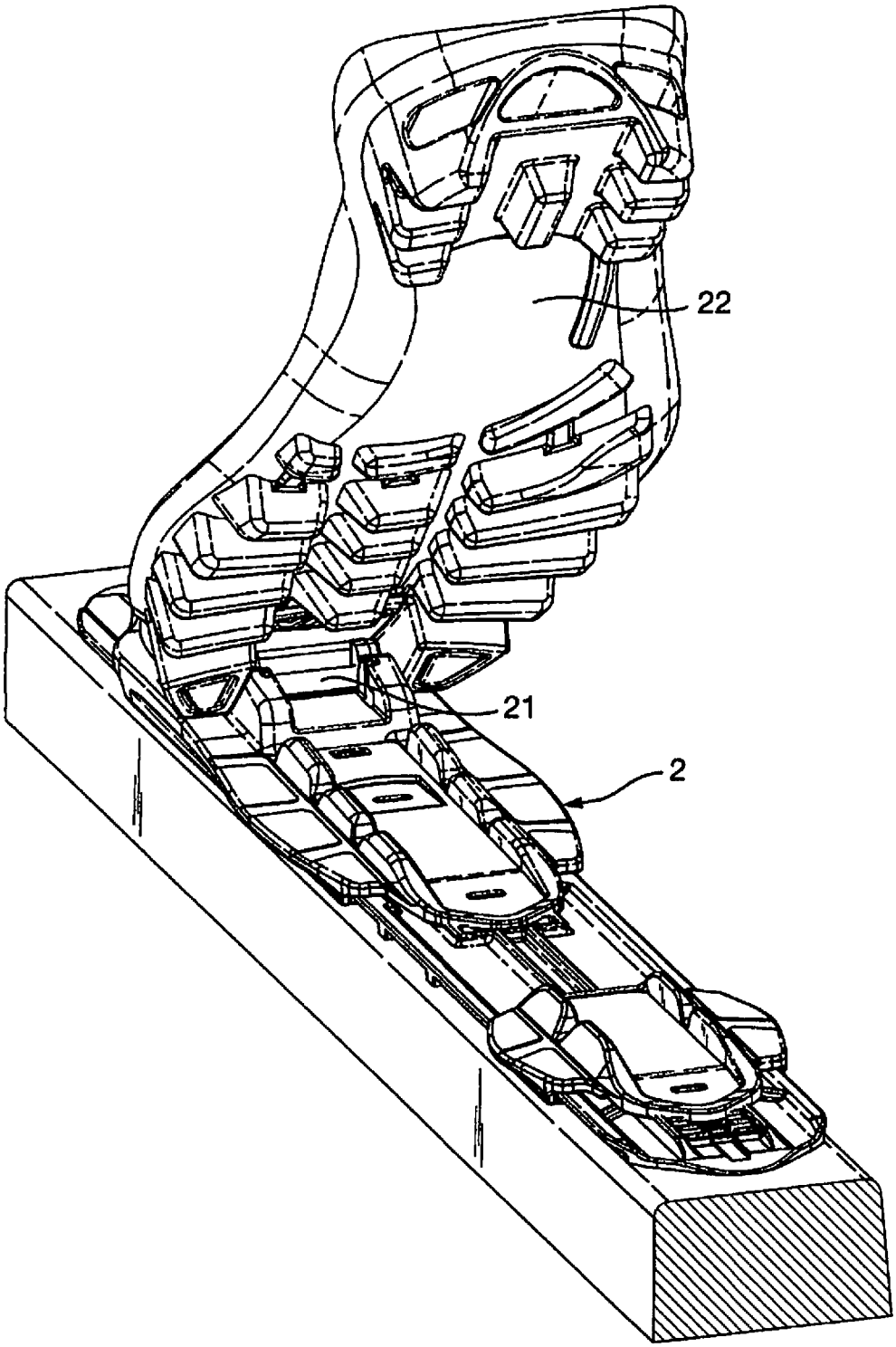

FIGS. 15 and 16 illustrates the cross sections XV-XV and XVI-XVI of FIG. 4*a*, and illustrates a second operational aspect of the release- and locking mechanism of the front section of the ski binding according to the present invention;

FIGS. 17 and 18 represents a modification of the embodiment as illustrated in FIGS. 3, 7 and 10-16;

FIG. 19 is a perspective view of the top and front of the locking mechanism part of FIG. 10 according to the present invention and illustrates the locking slider in a locked position;

FIG. 20 is a perspective view of the top and backside of the locking mechanism part of FIG. 10 according to the present invention and illustrates the locking slider in a locking position;

FIG. 21 illustrates a complete ski binding mounted on a ski binding attachment base-element according to the present invention, where the sole of a ski shoe is in a lifted position and locked to the binding.

Corresponding reference numerals indicate corresponding parts throughout the several views of the drawings.

DETAILED DESCRIPTION

The invention will now be described in further detail by way of exemplary illustrations herein below. However, it is envisaged that the shape and constructive design of one or more of the parts to be assembled may be modified shape wise without influencing the function and the assembly steps of the binding.

Figure 1:
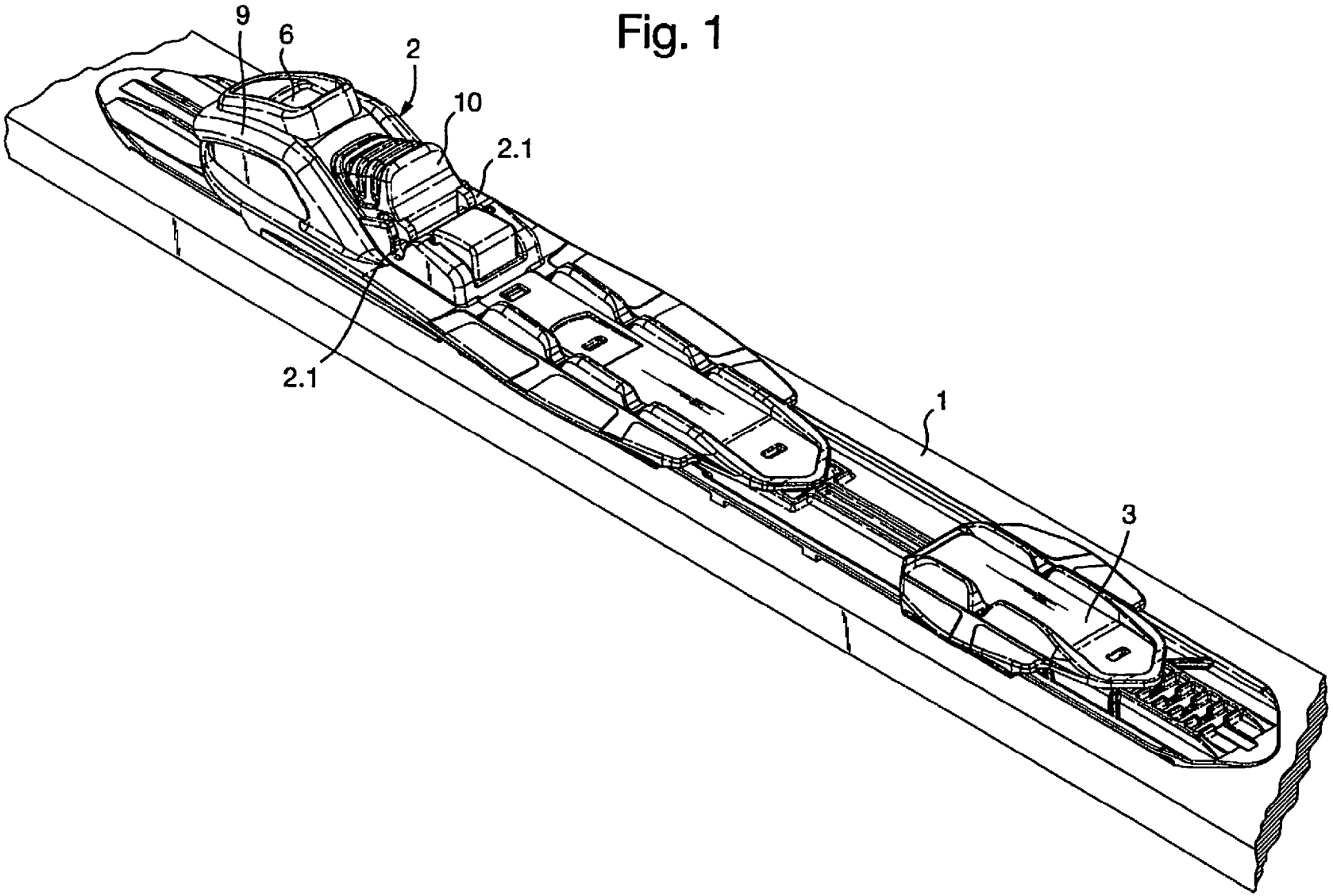
FIG. 1 illustrates a complete ski binding mounted on a ski by a binding attachment base-element according to the present invention.

FIG. 1 illustrates a ski binding 2,3 fixed to the upper surface of a ski 1, where the ski binding comprises a front element having an engagement section 2.1 for pivotal engagement of a ski shoe engagement pin 21, and a rear binding element 3 for engagement with a slit in the underside of the heel of the ski shoe. The front and rear elements of the ski binding also appear from FIG. 2. The ski have on its upper surface a ski binding fastening base element 1.1, e.g. a so called NIS-plate, to which the front and rear binding elements 2,3 can be releasable fastened by snap fastening. Also, by utilizing such an element 1.1 adjustable positioning of the elements 2,3 along the ski becomes possible to adjust to the ski shoe size and the substantially vertical load on the ski. The base element 1.1 can be fastened to or integrated with a ski 1. Alternatively, could the elements 2,3 be fastened to the ski by use of regular screws or other fastening means could be used.

Figure 3:
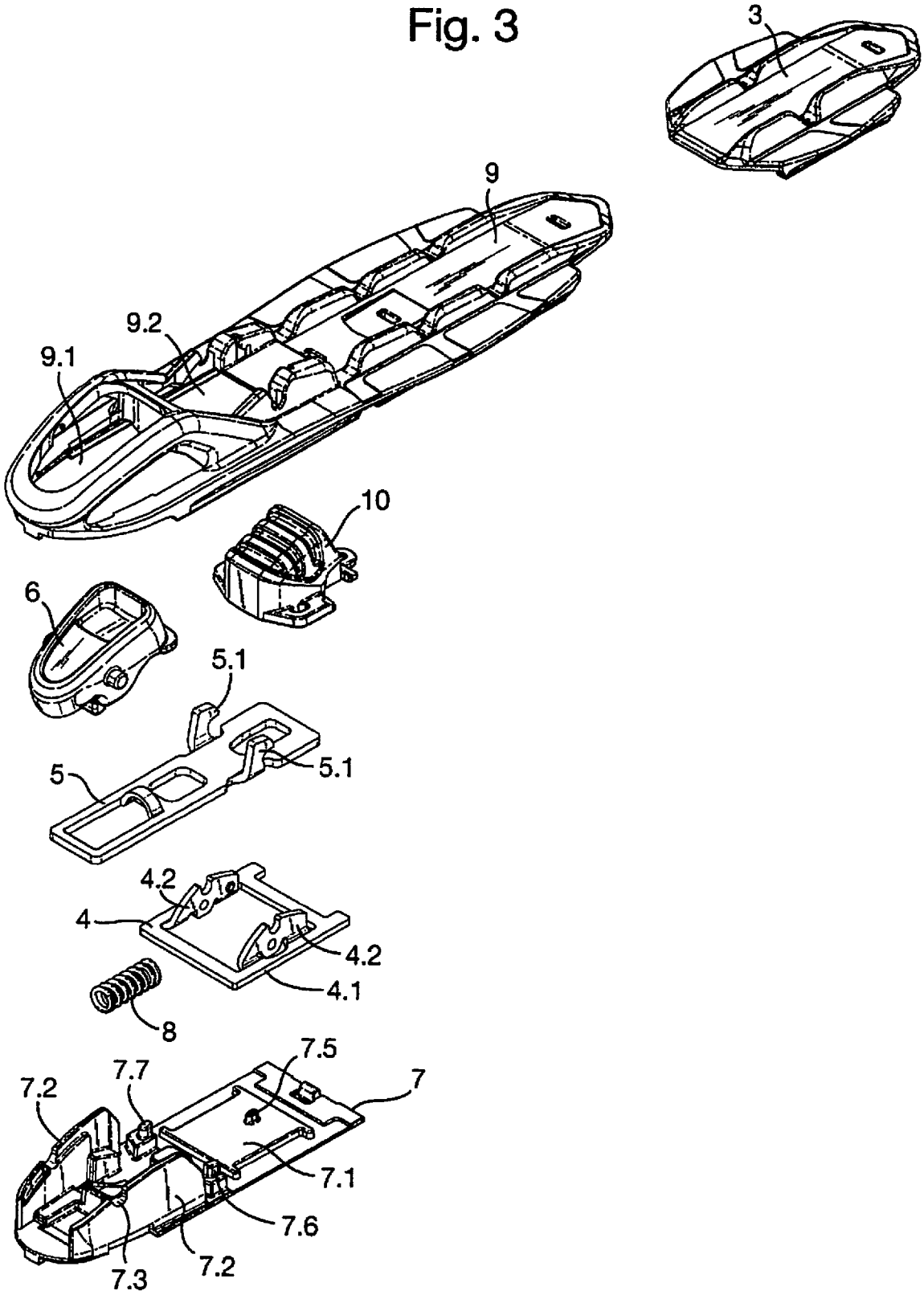
FIG. 3 is an exploded view of the ski binding sections of FIG. 2.

Now with reference to FIG. 3 showing an exploded view of the ski binding. The engagement section 2.1 of the binding includes a first stationary engagement part 4 and a movable engagement part 5. A spring-loaded activation element 6 is also provided to move the movable engagement part 5 between a locking position and a release position of the ski shoe. Further, a first housing section 7 exists having a bottom 7.1 and a pair of side elements 7.2 extending from the bottom 7.1 and providing bearing surfaces 7.3 for the fulcrum pins 6.1 of the activation element 6.

The stationary engagement part 4 includes a base 4.1 and a pair of protruding elements 4.2, which at top have recesses 4.3 to provide the engagement section 2.1, as shown in more detail in FIGS. 10-20.

The movable engagement part 5 is a slider in sliding engagement with the stationary engagement part 4 and in sliding engagement with slider guides 7.4 of the first housing section 7. The movable engagement part 5 includes at a rear area thereof a pair of protruding locking elements 5.1, e.g. hook shaped elements, extending from a base 5.2 of the movable engagement part 5. Each locking element 5.1 in locking position for the movable engagement part 5 is positioned sideways in relation to adjacent recess 4.3 on the stationary engagement section 4 to provide in co-operation with said recess 4.3 a means for locking the engagement pin 21, see FIGS. 11, 13, 15, 17 and 20. Each locking element 5.1 in ski shoe releasing position of the movable engagement part 5 is positioned forward in relation to the adjacent recess 4.3 of the stationary engagement part 4, that is, displaced from the recess 4.3 in the lengthwise direction of the binding, see FIGS. 12, 14, 16 and 18.

Activation element 6 includes a button 6.2 extending downwards to directly engage a forward positioned opening 5.3 in the slider, whereby the slider 5 is slided forward to a releasing position by a downwards pushing operation on the activation element 6 at a position behind its fulcrum pins 6.1. A lower edge 6.4 of each sidewall of the activation element, at a position below the fulcrum pins 6.1, is curved. The curved lower edge 6.4 sits on a neighboring surface of the base 5.2 of the slider shaped movable engagement part 5 to reduce the stress on the fulcrum pins 6.1.

A spring 8 is positioned between an abutment 7.5 at the bottom 7.1 of the first housing section 7 and an abutment 5.4 on the slider shaped movable engagement part 5 to provide spring loading of the movable engagement part 5 and the activation element 6.

As illustrated in FIGS. 3 and 10-16, the stationary engagement part 4 is positioned under the slider shaped movable engagement part 5 and rests on the bottom 7.1 of the first housing section, whereby the movable engagement part 5 at its front area is sliding on top of the bottom 7.1 of the first housing section 7 and at its rear area slides on top of the stationary engagement section 4.

In the alternative illustrated in FIGS. 17 and 18, the stationary engagement part 4 is positioned above the slider shaped movable engagement section 5, and the stationary engagement section 4 has feet or other types of fastening means (not clearly shown) resting on the bottom 7.1 of the first housing section 7, whereby the movable engagement part 5 on its underside is sliding on the bottom 7.1 of the first housing section 7 and with its upper surface of its rear area sliding connects with a underside surface of the stationary engagement part 4.

The element 6 acts as a release mechanism, and due to the button 6.2 co-operating with opening 5.3 of the movable engagement part 5, and the part 5 is spring-loaded by the spring 8, element 6 is also spring-loaded. It should be noted that the outside of engagement pocket 7.5 constitute one of the guides 7.4 for part 5.

An important aspect of the present invention is that element 6 is arranged to directly exert a force on the movable engagement section 5, that in reality constitutes a ski shoe fastening element.

By activation of the release element 6 by exertion of a release force, e.g. by utilizing the pointed end of a ski pole; on position 6.2, is a substantial stress applied the fulcrum pins 6.1 from the bearing surfaces 7.3 on the side elements 7.2 provided a remedy is provided to reduce such stress. To avoid breakage in the release mechanism, i.e. fulcrum pins 6.1, as a result of substantial vertical release force, represents the provision of the curved bottom edge 6.4 to ride the adjacent surface of the base 5.2 of the slider shaped movable engagement part 5, that the vertically directed stress component exerted on the fulcrum pins is substantially reduced, and the smaller stress component working in the vertical direction on the fulcrum pins, will have an acceptable value. Hence, the stress exerted on the fulcrum pins will be within fully acceptable limits. The risk of malfunction is with that removed. It should also be envisaged that when element 6 via its button 6.2 displaces the movable engagement part 5 in a forwards direction, the curved bottom edge 6.4 by frictional contact with the base 5.2 of the part 5 assist the operation of the button 6.2.

FIG. 21 illustrates the sole of a ski shoe or ski boot wherein the front area of the sole comprises an engagement pin 21 attached to the ski binding 2, whereby the engagement pin is lies in the engagement section 2.1 and is locked by locking element 5.1.

As indicated in the exploded view of FIG. 3 is a second housing part 9 provided, the second housing section 9 being adapted to snap connection from above on the first housing section 7. The second housing section 9 has at a front area thereof a pair of recesses 9.1 for pivotal engagement with an upper part of the fulcrum pins 6.1. The second housing section 9, at the position of the protruding elements 4.2, 5.1 of the stationary and movable engagement parts 4, 5, has an opening 9.2. The second housing section 9 effects that the fulcrum pins 6.1 of the element 6 is limited in upwards movement, and also effects that the stationary and movable engagement element 5, 6 is limited in upwards movement.

At least one resilient elements 10, 11 is fastenable to the second housing section 9, where at least one resilient element is fastenable in front of or behind the engagement section 2.1 for pivotal engagement of the ski shoe. The front resilient element 10 is preferably fastenable to the second housing section 9 from underneath the second housing section 9, by utilizing pins on the underside of the element 10 to engage holes in flanges of element 10.

The behind, or rear, resilient element 11 is fastenable to the second housing section from above by snap connection. The resilient elements 10, 11 are present to provide backwards and forwards biasing, respectively, of the rotation of the ski shoe. In addition the resilient elements 10, 11 aid to keep snow from entering the inner part of the ski binding.

The elements 12, 13 in FIG. 3 are only plates of decorative and cover purposes and have no further functionality As is understood from viewing FIG. 3, the first housing section 7, the stationary engagement part 4, the movable engagement part 5, the spring 8, the activation element 6, and the second housing section 9, all capable of being assembled by successive vertical directed mounting steps. To further explain the method steps of assembly of the functional parts of the touring- and cross-country ski binding, according to the present invention, comprises the following steps:

a) providing the first housing section 7;

b) downwards vertical moving one end of a spring 8 against an abutment 7.5 of the first housing section 7, whereby the spring extends in longitudinal direction of the first housing section 7;

c) positioning, by downwards vertical motions, the stationary 4 and movable 5 engagement parts on the bottom 7.1 of the first housing section 7, whereby the movable engagement part 5 is arranged in sliding engagement with guides 7.4 of the first housing section and in abutment with the second end of the spring 8;

d) positioning, by a downwards vertical motion, the activation element 6 on the first housing section 7, whereby the downwards pointing button 6.2 of the activation element 6 is arranged in abutment with the opening 5.3 in front of the movable engagement part 5; and e) connecting by a downwards vertical motion, the second housing section 9 on the first housing section 7 by means of an interlocking snap connection.

An important aspect of the method disclosed above is the fact that the ski binding can be assembled for one side only, and mainly in the same inserting direction. As such, the ski binding of the present invention can also be assembled by following steps:

a) providing and turning the second housing section 7 upside down;

b) positioning, by a downwards vertical motion, the activation element 6 on the second housing section 9, thereby positioning the fulcrum pins 6.1 of the activation element into the recesses 9.1 of the second housing section, and the downwards (that is, as long as the second housing section is upside down, actually pointing upwards) pointing button 6.2 of the activation element 6 is arranged in abutment with the opening 5.3 in front of the movable engagement part 5;

c) positioning, by downwards vertical motions, the stationary 4 and movable 5 engagement parts on the underside of the second housing section, whereby the pair of protruding elements 4.2 and the at least one locking element 5.1 is accommodated in the opening 9.2 of the second housing section 9;

d) downwards vertical moving one end of a spring 8 against the abutment 5.4 of the movable engagement part 5, whereby the springs in longitudinal direction of the second housing section 9;

e) connecting by a downwards vertical motion, the first housing section 7 on the second housing section 9 by means of an interlocking snap connection, whereby the movable engagement part 5 is arranged in sliding engagement with guides 7.4 of the first housing section and in abutment with the second end of the spring 8.

Step c) of either of the above disclosed methods comprises positioning the stationary engagement part 4 prior to providing the movable engagement part 5, as illustrated in FIGS. 3 and 10-16.

In an alternative, as also explained above with reference to the FIGS. 17 and 18, can step c) comprise positioning the movable engagement part 5 prior to positioning the stationary engagement part 4.

As disclosed above, according to the first method the resilient element 10 is inserted from below in front of the engagement section 2.1 in the opening 9.2 of the second housing section 9 prior to performing step e), and the element can have holes adapted for tight fitting on pins on underneath the second housing section 9.

It is envisaged that if the ski binding is assembled manually, then no tools are required to perform the operations. If the operations is automated by use of robots, then no sophisticated tools are required. FIGS. **4*a*-9 are merely attached to illustrate how the invention can be utilized industrially, with additional guidance from the exploded view of FIG. 3, and the detail of the release- and ski boot fastening mechanism illustrated in FIGS. 10-21**.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method for assembling functional parts of a touring- or cross country ski binding to provide a binding for releasable engagement with an engagement means of a ski shoe, comprising the steps of:

a) providing a first housing section;

b) positioning, by a downwards vertical motion, one end of a spring against an abutment of the first housing section, whereby the spring extends in longitudinal direction of the first housing section;

c) positioning, by downwards vertical motion, stationary and movable engagement parts on a bottom of the first housing section, whereby the movable engagement part is arranged in sliding engagement with guides of the first housing section and in abutment with the second end of the spring;

d) positioning, by a downwards vertical motion, an activation element on the first housing section, whereby a downwards pointing button of the activation element is arranged in abutment with an opening in front of the movable engagement part; and e) connecting by a downwards vertical motion, a second housing section on the first housing section by means of an interlocking snap connection.

2. The method according to claim 1, wherein step d) further comprises:

positioning fulcrum pins of the activation element in bearing surfaces on a pair of side elements extending from the first housing section.

3. The method according to claim 1, wherein step c) comprises positioning the stationary engagement part prior to positioning the movable engagement part.

4. The method according to claim 1, wherein step c) comprises positioning the movable engagement part prior to positioning the stationary engagement part.

5. The method according to claim 1, wherein a resilient element is positioned by a downwards vertical motion on top of the stationary and movable engagements parts prior to performing step e).

6. The method according to claim 1 wherein a resilient element is positioned in an opening of the second housing section prior to performing step e).

7. A method for assembling functional parts of a touring- or cross country ski binding to provide a binding for releasable engagement with an engagement means of a ski shoe, comprising the steps of:

a) moving a spring in a downwards vertical motion so a first end of the spring abuts against an abutment of a first housing section, whereby the spring extends in a longitudinal direction of the first housing section;

b) moving a stationary part and a movable engagement part in a downwards vertical motion onto a bottom of the first housing section, whereby the movable engagement part is arranged in sliding engagement with guides of the first housing section and in abutment with a second end of the spring;

c) moving an activation element in a downwards vertical motion onto the first housing section, whereby a downwards pointing button of the activation element is arranged in abutment with an opening in front of the movable engagement part; and d) moving a second housing section in a downwards vertical motion to connect on the first housing section by means of an interlocking snap connection;

wherein the ski binding is assembled from one side in mainly the same direction.

8. The method of claim 7, wherein step b) comprises positioning the stationary engagement part prior to positioning the movable engagement part.

9. The method of claim 8, further comprising:

positioning fulcrum pins of the activation element in bearing surfaces on a pair of side elements extending from the first housing section.

10. The method of claim 7, further comprising:

positioning a curved bottom edge of the activation element to ride on a surface of the moveable engagement part during a movement of the activation element.

11. The method of claim 10, wherein the surface of the moveable engagement member is adjacent the opening in front of the movable engagement part.

* * * * *